US010647944B2

(12) United States Patent
Tang et al.

(10) Patent No.: US 10,647,944 B2
(45) Date of Patent: May 12, 2020

(54) CLEANING COMPOSITIONS CONTAINING BRANCHED ALKYL SULFATE SURFACTANT WITH LITTLE OR NO ALKOXYLATED ALKYL SULFATE

(71) Applicant: The Procter & Gamble Company, Cincinnati, OH (US)

(72) Inventors: Ming Tang, Beijing (CN); Qing Chen, Beijing (CN); Wenting Liu, Beijing (CN)

(73) Assignee: The Procter & Gamble Company, Cincinnati, OH (US)

( * ) Notice: Subject to any disclaimer, the term of this patent is extended or adjusted under 35 U.S.C. 154(b) by 6 days.

(21) Appl. No.: 15/345,541

(22) Filed: Nov. 8, 2016

(65) Prior Publication Data

US 2017/0137748 A1 May 18, 2017

(30) Foreign Application Priority Data

Nov. 13, 2015 (WO) ..... PCT/CN2015/094513

(51) Int. Cl.

| | |
|---|---|
| ***C11D 1/00*** | (2006.01) |
| ***C11D 1/14*** | (2006.01) |
| ***C11D 1/37*** | (2006.01) |
| ***C11D 3/00*** | (2006.01) |
| ***C11D 1/29*** | (2006.01) |
| ***C11D 1/75*** | (2006.01) |
| ***C11D 3/10*** | (2006.01) |
| ***C11D 11/00*** | (2006.01) |
| ***C11D 17/06*** | (2006.01) |

(52) U.S. Cl.

CPC ..... *C11D 1/146* (2013.01); *C11D 1/29* (2013.01); *C11D 1/37* (2013.01); *C11D 1/75* (2013.01); *C11D 3/0094* (2013.01); *C11D 3/10* (2013.01); *C11D 11/0017* (2013.01); *C11D 11/0023* (2013.01); *C11D 17/06* (2013.01)

(58) Field of Classification Search

IPC ..... C11D 1/00

See application file for complete search history.

(56) References Cited

U.S. PATENT DOCUMENTS

| | | | |
|---|---|---|---|
| 3,563,901 | A | 2/1971 | Crotty |
| 5,646,107 | A | 7/1997 | Emery et al. |
| 5,780,624 | A | 7/1998 | Wingert |
| 6,294,513 | B1 | 9/2001 | Jensen et al. |
| 6,433,207 | B1 | 8/2002 | Connor |
| 6,677,289 | B1 | 1/2004 | Price et al. |
| 7,608,653 | B2 | 10/2009 | Wulff et al. |
| 7,923,426 | B2 | 4/2011 | Price et al. |
| 8,987,179 | B2 | 3/2015 | Himmrich |
| 9,080,129 | B2 | 7/2015 | Benlahmar et al. |
| 9,340,753 | B2 | 5/2016 | Tang |
| 9,828,569 | B2 | 11/2017 | Mort, III |
| 10,266,791 | B2 | 4/2019 | Tang |
| 2005/0026803 | A1 | 2/2005 | Sivik et al. |
| 2005/0124738 | A1 | 6/2005 | Sivik et al. |
| 2008/0146482 | A1 | 6/2008 | Schneiderman et al. |
| 2009/0270304 | A1 | 10/2009 | Cermenati et al. |
| 2009/0305939 | A1 | 12/2009 | Tang et al. |
| 2010/0182637 | A1 | 7/2010 | Tamura |
| 2010/0323946 | A1 | 12/2010 | Connors et al. |
| 2013/0029894 | A1 | 1/2013 | Bettiol |
| 2013/0029895 | A1 | 1/2013 | Bettiol |
| 2014/0366281 | A1 | 12/2014 | Mort, III et al. |
| 2015/0191676 | A1 | 7/2015 | Liu et al. |
| 2015/0275135 | A1* | 10/2015 | Si ..... C08F 220/56 510/341 |
| 2015/0337236 | A1 | 11/2015 | Tang et al. |
| 2017/0137745 | A1 | 5/2017 | Tang et al. |
| 2017/0137746 | A1 | 5/2017 | Tang et al. |
| 2017/0137747 | A1 | 5/2017 | Tang et al. |

FOREIGN PATENT DOCUMENTS

| | | | |
|---|---|---|---|
| CA | 2219669 | A | 5/1998 |
| EP | 0439316 | A2 | 7/1991 |
| EP | 0829530 | A1 | 3/1998 |
| EP | 874041 | A | 10/1998 |
| EP | 2119764 | A | 11/2009 |
| EP | 2581438 | A | 4/2013 |
| GB | 2278124 | A | 11/1994 |
| JP | S58194997 | A | 11/1983 |
| JP | A-2005-171131 | A | 6/2005 |
| JP | 2005325281 | A | 11/2005 |
| WO | 9500117 | A | 1/1995 |
| WO | 9631589 | A | 10/1996 |
| WO | 9738956 | A | 10/1997 |

(Continued)

OTHER PUBLICATIONS

International Search Report; International Application No. PCT/CN2015/094510; 5 pages.

International Search Report; International Application No. PCT/CN2015/094511; 5 pages.

International Search Report; International Application No. PCT/CN2015/094512; 4 pages.

International Search Report; International Application No. PCT/CN2015/094513; 4 pages.

(Continued)

*Primary Examiner* — Necholus Ogden, Jr.

(74) *Attorney, Agent, or Firm* — John T. Dipre

(57) ABSTRACT

Cleaning compositions with improved sudsing profiles are provided, which contain a high level of one or more branched and unethoxylated $C_6$-$C_{14}$ alkyl sulphate anionic surfactants as a primary surfactant, with little or no alkoxylated alkyl sulfate and preferably without any suds suppressors. Such cleaning compositions are particularly suitable for hand-washing dishes or fabrics.

4 Claims, 1 Drawing Sheet

(56) References Cited

FOREIGN PATENT DOCUMENTS

| | | | |
|---|---|---|---|
| WO | 9739087 | A | 10/1997 |
| WO | 9739088 | A | 10/1997 |
| WO | 9739090 | A | 10/1997 |
| WO | 9739091 | A | 10/1997 |
| WO | 9919434 | A1 | 4/1999 |
| WO | 9919453 | A | 4/1999 |
| WO | WO9918928 | A1 | 4/1999 |
| WO | 200105923 | A | 1/2001 |
| WO | 200105924 | A | 1/2001 |
| WO | 2006113313 | A | 10/2006 |
| WO | WO 2014/018309 | A1 | 1/2014 |

OTHER PUBLICATIONS

U.S. Appl. No. 15/345,529, filed Nov. 8, 2016, Tang, et al.
U.S. Appl. No. 15/345,531, filed Nov. 8, 2016, Tang, et al.
U.S. Appl. No. 15/345,535, filed Nov. 8, 2016, Tang, et al.
Sasol's C12-C13 Alcohols Technical Bulletin; Sasol reaching new frontiers; 1 page.

* cited by examiner

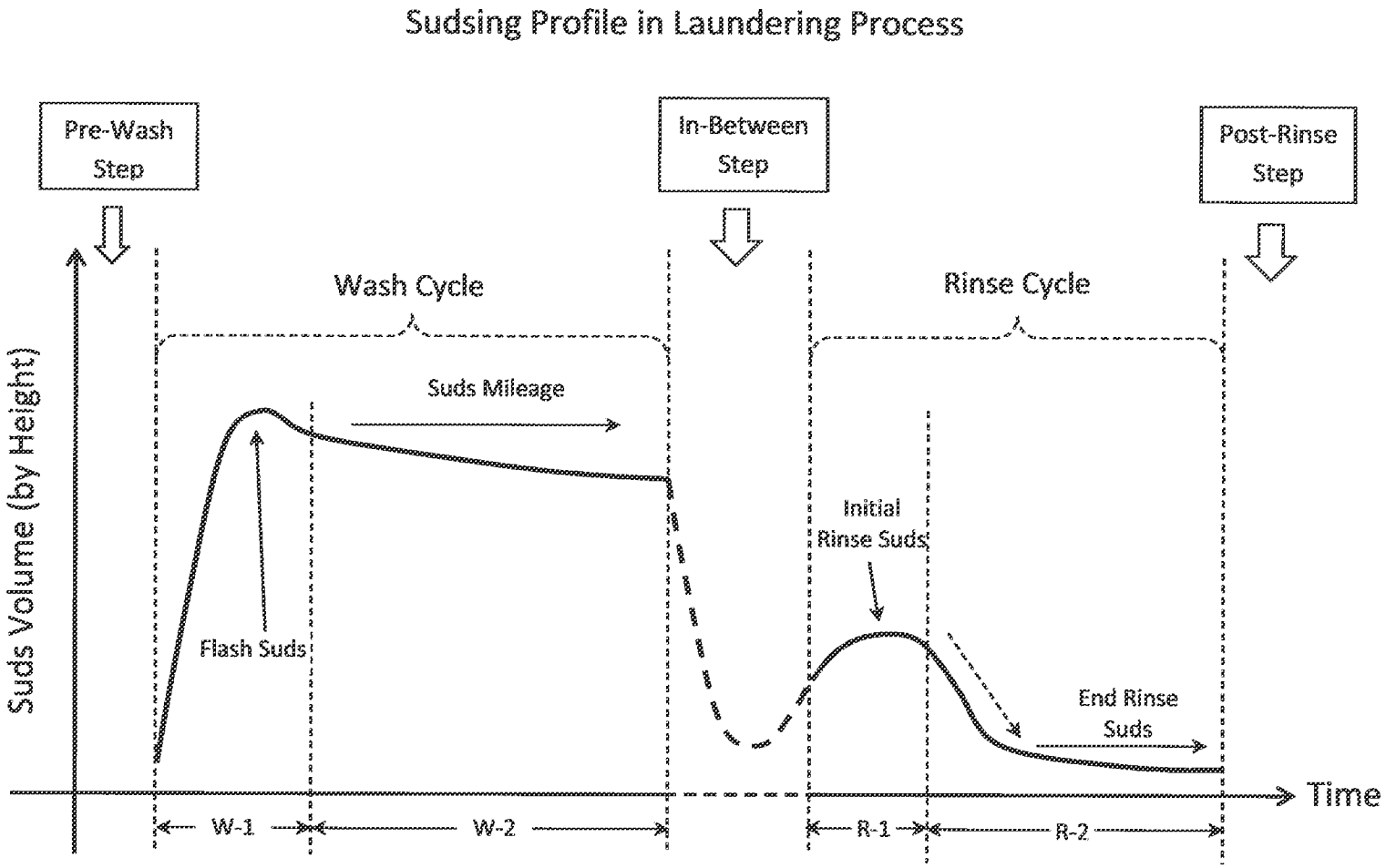
Sudsing Profile in Laundering Process
Pre-Wash Step
In-Between Step
Post-Rinse Step
Wash Cycle
Rinse Cycle
Suds Mileage
Flash Suds
Initial Rinse Suds
End Rinse Suds
W-1
W-2
R-1
R-2
Suds Volume (by Height)
Time

CLEANING COMPOSITIONS CONTAINING BRANCHED ALKYL SULFATE SURFACTANT WITH LITTLE OR NO ALKOXYLATED ALKYL SULFATE

FIELD OF THE INVENTION

The present invention relates generally to cleaning compositions, particularly to laundry or dish detergent compositions, and more particularly to detergent compositions specifically designed for manual/hand washing or semi-automatic washing of fabric or dishware.

BACKGROUND OF THE INVENTION

Detergents comprising anionic detersive surfactants for cleaning fabrics have been known for many years. Historically, cleaning laundry was defined primarily as a process that involved removal of stains. Consistent with this historical approach to cleaning, laundry detergent designers focused on formulating detergents with surfactants with longer carbon chains to ensure maximum surface activity of the surfactants to achieve the most effective soil removal.

Such long-chain surfactants can generate copious suds during wash cycles of the fabric laundering process. Therefore, consumers view high suds volume as the primary and most desirable signal of cleaning. For hand-washing consumers, who are still the dominating majority in most developing countries, high suds volume are especially desirable, since the consumers can directly feel and touch suds generated during the hand-washing process and intuitively correlate high suds volume with sufficient fabric cleaning.

Paradoxically, high volume of suds during the wash cycle will typically translate to more suds in the subsequent rinse cycle. When consumers observe suds during the rinse cycle, they immediately infer from it that there may still be surfactant residue on the fabrics. Surfactant residue remaining on the fabrics may cause irritation to the skin, and it may also render the fabrics "sticky" after drying, thereby likely to attract more dirt upon wearing. Consequently, the consumers will feel the need to rinse the fabric a few more times, until suds are completely or substantially disappeared from the rinse solution, signaling that the fabrics are now "clean" and free of surfactant residue. However, oftentimes one or two rinses are sufficient to remove most or all of surfactant residue from the fabrics, despite a significant amount of suds remaining in the rinse solution. In other words, the additional rinses are unnecessary and excessive. Such excessive rinsing requires additional time, labor, energy and water. For regions where resources are scarce, especially those regions suffering from water shortage, excessive rinsing is particularly undesirable.

Therefore, a sudsing profile of a detergent composition during both wash and rinse cycles of the fabric laundering process is important for the overall consumer laundering experience, particularly for hand-washing consumers.

There is a need to provide consumers with an improved laundry cleaning (i.e., laundering) experience, especially those consumers who are accustomed to manually washing their laundry, either entirely (i.e., full manual/hand laundering) or in conjunction with machine washing (i.e., semi-automatic laundering). Specifically, this improved laundering experience is enabled by a desired sudsing profile defined by at least four (4) key points of consumer observation (hereinafter "touch points"), which jointly connote to the consumer that the laundry is sufficiently cleaned and rinsed. A failure at any one of these touch points may result in the consumer having a less than an ideal laundering experience.

These four touch points, which are hereby labeled as "Flash Suds," "Suds Mileage," "Initial Rinse Suds," "End Rinse Suds," are explained hereinafter with reference to FIG. 1, which illustrates a typical laundering process with a wash cycle followed by a rinse cycle.

Prior to the wash cycle, i.e., during a pre-wash step, a consumer will dissolve a laundry detergent product in a specific amount of water to form aqueous wash liquor, and the laundry to be treated will be brought into contact with the wash liquor.

The wash cycle starts with mechanical agitation of the laundry with the wash liquor, either in a washing machine or directly by the hands of the consumer, which leads to an initial bloom of suds that is characterized by a significantly high volume of suds (measured by height) generated at a relatively high speed (within the first 2-3 minutes of the wash cycle) during a first stage of the wash cycle, i.e., the "W-1" stage shown in FIG. 1. This initial bloom of suds, or the so-called "Flash Suds," constitutes the first touch point, which signals that the surfactant in the laundry detergent is working effectively to clean the laundry. The second touch point calls for sustainment or maintenance of the wash suds volume or height at a relatively level, i.e., the so-called "Suds Mileage," throughout a second, subsequent stage of the wash cycle (the "W-2" stage shown in FIG. 1).

These two initial touch points indicate to the consumer that the laundry detergent is efficacious in cleaning the laundry and remains so throughout the entire wash cycle. If there are no flash suds or if the flash suds volume is not high enough at the W-1 stage, then the consumer may interpret that the laundry detergent product as not being efficacious. If the suds mileage is not maintained throughout a significant portion of the W-2 stage of the wash cycle, the consumer may interpret that the laundry detergent product is losing cleaning efficacy or that there is not enough surfactant in the detergent to effectively clean the entire laundry bundle.

After the wash cycle and before the rinse cycle, i.e., during an in-between step, the sufficiently washed laundry is separated from the wash liquor. The wash liquor is drained or otherwise disposed. The laundry is wrung or spun to remove any excess wash liquor, followed by contacting the laundry with clean water or a rinse solution. The suds volume (measured by height) during this in-between step is inconsequential to the consumer, so it is not measured, and the dotted line only indicates the approximate suds volume (measure by height) during this step for illustration purposes.

During the rinse cycle, mechanical agitation (either by machine or by hand) is also applied to the laundry in the rinse solution, in attempt to rinse any carry-over or residue surfactant and soil off the laundry. At a first stage of the rinse cycle, i.e., the "R-1" stage in FIG. 1, some initial suds may be observed in the rinse solution, which is referred to as the "Initial Rinse Suds." A portion of such initial rinse suds as shown in FIG. 1 is carried over by the laundry from the wash cycle, i.e., residue suds attached to the laundry. The remaining portion of the initial rinse suds is generated by mechanical agitation of the rinse solution, due to the presence of carry-over or residue surfactant therein. Such initial rinse suds constitute the third touch point, which is preferably of a moderate volume (measured by height). The consumer expects to see some initial rinse suds, given the carryover of surfactant from the washed laundry. Complete absence of initial rinse suds may cause the consumer to doubt the efficacy of previous wash cycle.

The fourth touch point calls for fast and significant withering of suds (indicated by the dotted arrowhead) at a second, subsequent stage of the rinse cycle (the "R-2" stage of FIG. 1) that leads to a zero or near-zero "End Rinse Suds" volume (measured by height). Despite continued agitation, the rinse suds volume (measured by height) decreases significantly and quickly during this stage to a zero or near zero level. Note that both magnitude and speed of such suds decrease at the R-2 stage are important, because jointly they signal effective rinsing of the laundry. At the end of the R-2 stage, the rinse suds are eliminated or nearly eliminated, which connotes to the consumer that most or all of the residue surfactant has been rinsed off the laundry and he/she can move on to the post-rinse step, e.g., drying and/or ironing the laundry. Accordingly, the consumer can confidently stop rinsing and end the laundering process, which will help not only to save water but also to save the consumer's time.

During the R-2 stage, if the rinse suds decrease is not significant or fast enough to lead to zero or near-zero End Rinse Suds volume (measured by height), it connotes to the consumer that there is still residue surfactant in the washed laundry or the rinse solution. Consequently, the consumer feels that the rinse is not completed yet and may needlessly spend additional time rinsing and/or using additional rinse water until all of the suds are eliminated or nearly eliminated. Therefore, it is important that the fourth touch point is present to connote that the detergent product can be easily rinsed away from the washed laundry, i.e., it is an easy-rinse formulation, which can provide a key point of differentiation for laundry detergent products.

A laundry detergent product that provides an optimized sudsing profile at all four touch points discussed hereinabove connotes high cleaning efficacy as well as the easy rinse benefits of the laundry detergent product. It may also help the consumer to save water and/or may reduce the time the user takes in rinsing the laundry. Conventional laundry detergents may provide a laundering experience at one or more of these touch points, but never has a product provided consumers with an optimized sudsing profile at all four of these touch points (while also providing cleaning efficacy). Accordingly, there is a need for such a laundry detergent product.

SUMMARY OF THE INVENTION

It has been an unexpected discovery of the present invention that unalkoxylated alkyl sulfates with branched $C_6$-$C_{14}$ alky chains, when used as the primary surfactant at sufficiently high levels, can significantly improve the overall sudsing profile of a cleaning composition containing the same so as to provide enhanced consumer experience at all four touch points as described hereinabove.

Specifically, the present invention provides a cleaning composition having a surfactant system comprising one or more branched, unalkoxylated $C_6$-$C_{14}$ alkyl sulfate (BAS) surfactants, while such one or more BAS surfactants account for more than 50% by total weight of the surfactant system, and are present in an amount ranging from 10% to 50% by total weight of the cleaning composition, which is substantially free of any alkoxylated alkyl sulfate (AxS).

Preferably, the cleaning composition is substantially free of silicone suds suppressors, and more preferably it is free of any suds suppressors.

The present invention also relates to a method of treating soiled material, comprising the steps of: a) providing a cleaning composition as mentioned hereinabove; b) contacting the cleaning composition with at least a portion of the soiled material; and c) rinsing the soiled material.

Further, the present invention is related to the use of a cleaning composition as described hereinabove for hand-washing dishes or fabrics.

Still further, the present invention relates to the use of a surfactant system comprising one or more branched, unalkoxylated $C_6$-$C_{14}$ alkyl sulfate (BAS) surfactants to improve sudsing profile of a cleaning composition, while such one or more BAS surfactants account for more than 50% by total weight of the surfactant system, and while the surfactant system is substantially free of any alkoxylated alkyl sulfate (AxS).

These and other features of the present invention will become apparent to one skilled in the art upon review of the following detailed description when taken in conjunction with the appended claims.

BRIEF DESCRIPTION OF THE DRAWINGS

FIG. 1 is a graph illustrates a desired sudsing profile with four (4) touch points at various stages of the wash and rinse cycles of a laundering process.

DETAILED DESCRIPTION OF THE INVENTION

Definitions

As used herein, "suds" indicates a non-equilibrium dispersion of gas bubbles in a relatively smaller volume of a liquid. The terms like "suds", "foam" and "lather" can be used interchangeably within the meaning of the present invention.

As used herein, "sudsing profile" refers to the properties of a detergent composition relating to suds character during the wash and rinse cycles. The sudsing profile may include, but is not limited to: the initial speed of suds generation upon dissolution in a washing solution, the volume and retention of suds during the wash cycle, the look and feel of suds generated, the amount of residue suds carried over to the rinse solution, and the speed of suds reduction or disappearance during the rinse cycle, which are all connected with the fabric laundering experience of the consumers. Preferably, the sudsing profile may include Initial Wash Suds Volume (measured by height in centimeters), Suds Mileage (measured by height in centimeters), Wash Suds Retention Percentage (%), Rinse Suds at 0 Minute (volume measured by height in centimeters), Rinse Suds at 1 Minute (volume measured by height in centimeters), and Rinse Suds Reduction Rate (%/min), as measured by using the Sudsing Profile Test described hereinafter. More preferably, the sudsing profile of detergent compositions according to the present invention is defined by the Initial Wash Suds Volume (cm), the Suds Mileage (cm), and the Rinse Suds Reduction Rate (%/min), as measured by using the Sudsing Profile Test described hereinafter. These three parameters evaluate the four touch points as discussed hereinabove for the wash and rinse cycles. The sudsing profile may further include additional suds-related parameters.

As used herein, the term "cleaning composition" means a liquid or solid composition for treating fabrics, hard surfaces and any other surfaces in the area of fabric and home care, and includes hard surface cleaning and/or treatment including floor and bathroom cleaners (e.g., toilet bowl cleaners); hand dishwashing agents or light duty dishwashing agents, especially those of the high-foaming type; machine dishwashing agents; personal care compositions; pet care compositions; automotive care compositions; and household care compositions. In one embodiment, the cleaning composition of the present invention is a laundry detergent composition, which can be in liquid, powder, paste, gel, unit dose, pouch, or tablet form. In another embodiment, the cleaning composition is dish detergent composition, which also can be in liquid, powder, paste, gel, unit dose, pouch, or tablet form.

As used herein, the term "soiled material" is used non-specifically and may refer to any type of flexible material consisting of a network of natural or artificial fibers, including natural, artificial, and synthetic fibers, such as, but not limited to, cotton, linen, wool, polyester, nylon, silk, acrylic, and the like, as well as various blends and combinations. Soiled material may further refer to any type of hard surface, including natural, artificial, or synthetic surfaces, such as, but not limited to, surfaces of glass, metal, plastic, porcelain or ceramic cooking articles or utensils, and table, countertop or floor surfaces formed of tile, granite, grout, composite, vinyl, hardwood, and the like, as well as blends and combinations.

As used herein, the term "laundry detergent composition" is a subset of "cleaning composition", and includes all-purpose or "heavy-duty" washing agents for fabric, especially cleaning detergents in liquid, powder, paste, gel, unit dose, pouch, or tablet form, as well as cleaning auxiliaries such as bleach, rinse aids, additives or pre-treat types. In one embodiment, the laundry detergent composition is a heavy duty liquid laundry detergent; and in another embodiment, the laundry detergent composition is a free-flowing granular laundry detergent.

As used herein, articles such as "a" and "an" when used in a claim, are understood to mean one or more of what is claimed or described.

As used herein, the terms "comprising," "comprises," "include", "includes" and "including" are meant to be non-limiting. The term "consisting of" is meant to be limiting, i.e., excluding any components or ingredients that are not specifically listed except when they are present as impurities. The term "consisting essentially of," on the other hand, allows the presence of other components or ingredients as long as they do not interfere with the functions of those components or ingredients that are specifically listed.

As used herein, the term "substantially free of" or "substantially free from" refers to the presence of no more than 0.5%, preferably no more than 0.2%, and more preferably no more than 0.1%, of an indicated material in a composition, by total weight of such composition.

As used herein, the term "essentially free of" means that the indicated material is not deliberately added to the composition, or preferably not present at analytically detectable levels. It is meant to include compositions whereby the indicated material is present only as an impurity of one of the other materials deliberately added.

As used herein, the term "solid" includes granular, powder, bar and tablet product forms.

As used herein, the term "fluid" includes liquid, gel, paste and gas product forms.

As used herein, the term "liquid" refers to a fluid having a liquid having a viscosity of from about 1 to about 2000 mPa*s at 25° C. and a shear rate of 20 $sec^{-1}$. In some embodiments, the viscosity of the liquid may be in the range of from about 200 to about 1000 mPa*s at 25° C. at a shear rate of 20 $sec^{-1}$. In some embodiments, the viscosity of the liquid may be in the range of from about 200 to about 500 mPa*s at 25° C. at a shear rate of 20 $sec^{-1}$. The viscosity can be determined using a Brookfield viscometer, No. 2 spindle, at 60 RPM/s.

All temperatures herein are in degrees Celsius (° C.) unless otherwise indicated. Unless otherwise specified, all measurements herein are conducted at 20° C. and under the atmospheric pressure.

In all embodiments of the present invention, all percentages are by weight of the total composition, unless specifically stated otherwise. All ratios are weight ratios, unless specifically stated otherwise. The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

It is understood that the test methods that are disclosed in the Test Methods Section of the present application must be used to determine the respective values of the parameters of Applicants' inventions are described and claimed herein.

Inventors of the present invention has discovered that a cleaning composition containing one or more branched, unalkoxylated $C_6$-$C_{14}$ alkyl sulfates as the primary surfactant in its surfactant system (i.e., said one or more branched, unalkoxylated $C_6$-$C_{14}$ alkyl sulfates account for more than about 50% by total weight of the surfactant system) at a significantly high level (i.e., said one or more branched, unalkoxylated $C_6$-$C_{14}$ alkyl sulfates are present at from about 10% to about 50% by total weight of the cleaning composition) demonstrate a significantly improved sudsing profile, which is characterized by a high "Flash Suds" volume at the W-1 stage and good "Suds Mileage" at the W-2 stage of the wash cycle, a moderate amount of "Initial Rinse Suds" at the R-1 stage of the rinse cycle, and a drastically faster reduction and disappearance of rinse suds leading to zero or near-zero "End Rinse Suds" at the R-2 stage of the rinse cycle.

Such a unique sudsing profile provides hand-wash consumers with delightful washing and rinsing experience, especially during the rinse stage. The volume of suds generated and sustainability/stability thereof during the wash cycle are sufficiently high, thereby signaling to the consumer that effective cleaning is occurring. A moderate amount of suds is observed at the beginning of the rinse cycle, which is expected by the consumer after observing a large amount of suds generated during the wash as a sign of effective cleaning. However, once the rinse cycle starts, the suds undergo drastic and fast reduction and disappearance during the first one or two minutes of rinsing. Consumers, especially the ones conducting hand-wash, will have the chance to visually observe the drastic and fast reduction and disappearance of rinse suds, eventually resulting in a clear rinse solution with little or no suds at the end of the first rinse cycle. The visual perception of suds reduction and disappearance by the consumers provides a clear signal that the article to be cleansed has gone through effective cleaning and sufficient rinsing, and is now free of soil as well as residue surfactant. Therefore, the consumers will confidently stop the laundering process after the first rinse cycle, thus eliminating the need for additional rinses and potentially enabling the concept of single rinse.

The surprising and unexpected sudsing profile achieved by the cleaning compositions of the present invention is specifically characterized by a high Initial Wash Suds Volume, a high Suds Mileage, and a high Rinse Suds Reduction Rate, as measured by using the Sudsing Profile Test described hereinafter. Specifically, the unique sudsing profile is defined by: a) an Initial Wash Suds Volume (measured by height) of no less than about 30 cm; b) a Suds Mileage (measured by height) of no less than about 30 cm; and c) a Rinse Suds Reduction Rate of no less than about 40%/min, which are measured using the Sudsing Profile Test described hereinafter. The Initial Wash Suds Volume evaluates the first touch point, i.e, the "Flash Suds" as discussed hereinabove, during W-1 stage of the wash cycle. The Suds Mileage evaluates the second touch point as discussed hereinabove (therefore named after it) during W-2 stage of the wash cycle. The Rinse Suds Reduction Rate jointly evaluates the third and fourth touch points, i.e., the "Initial Rinse Suds" and "End Rinse Suds," as discussed hereinabove during R-1 and R-2 stages of the rinse cycle.

The Initial Wash Suds Volume can be as high as about 50 cm, so it may range from about 30 cm to about 50 cm. Preferably, the Initial Wash Suds Volume of the cleaning composition is no less than about 35 cm, preferably no less than about 40 cm, and more preferably no less than about 45 cm. More preferably, the Initial Wash Suds Volume ranges from about 35 cm to about 49 cm, preferably from about 40 cm to about 48 cm, and more preferably from about 45 cm to about 47 cm.

The Suds Mileage also has an upper limit of about 50 cm, so it may also range from about 30 cm to about 50 cm. Preferably, the Suds Mileage of the cleaning composition is no less than about 35 cm, preferably no less than about 37 cm, and more preferably no less than about 40 cm. More preferably, the Suds Mileage ranges from about 35 cm to about 48 cm, preferably from about 37 cm to about 46 cm, and more preferably from about 40 cm to about 45 cm.

The Wash Suds Retention Percentage, which is calculated from the Initial Suds Volume and the Suds Mileage, may range from 60% to 120%. Preferably, it is no less than 70%, or no less than 80%, or no less than 90%. More preferably, the Wash Suds Retention Percentage ranges from about 70% to about 100%, still more preferably from about 80% to about 100% or from about 90% to about 100%, and most preferably from about 95% to 100%.

The Rinse Suds Reduction Rate preferably ranges from about 40%/min to 100%/min. Preferably it ranges from about 50%/min to 100%/min. More preferably, it ranges from about 60%/min to 100%/min. Still more preferably, it ranges from about 70%/min to 100%/min. Yet more preferably, it ranges from about 80%/min to 100%/min. Most preferably, the Rinse Suds Reduction Rate of the cleaning composition of the present invention is 100%/min. This means that within one (1) minute from when the rinse cycle starts, all suds in the rinse solution disappear, resulting in a "zero suds" rinse solution. This is most extraordinary, because the rapid rinse reduction right before the consumer's eyes sends a strong visual signal to the consumer the rinse solution is now clear and that the rinse can be stopped.

Suds-Improving Surfactant System

Such an improved sudsing profile as described hereinabove can be achieved by employing a surfactant system which contains, as the primary surfactant in a majority weight percentage thereof (i.e., more than 50 wt %), one or more branched, unalkoxylated $C_6$-$C_{14}$ alkyl sulfate (hereinafter "BAS") surfactants.

It is important that the BAS surfactant of the present invention is unalkoxylated, because alkoxylation, even at a relatively low degree (e.g., a weight average degree of about 1), may adversely affect the Rinse Suds Reduction Rate of the resulting cleaning composition. Therefore, it is desirable to employ unalkoxylated alkyl sulfate surfactants instead.

Branching of the $C_6$-$C_{14}$ alkyl chain in the BAS surfactant is also important, because linear alkyl sulfates have poorer suds stability during the wash cycle, which in turn leads to significantly lower Suds Mileage. Therefore, it is desirable to employ branched alkyl sulfate surfactants instead.

Further, the BAS surfactants of the present invention are characterized by relatively short alkyl chains, i.e., with from about 6 to about 14 carbon atoms. Alkyl sulfate surfactants with longer alkyl chain may lead to a significantly lower Rinse Suds Reduction Rate in the resulting cleaning composition. Therefore, it is desirable to employ BAS surfactants with relatively short alkyl chains (i.e., $C_6$-$C_{14}$), and preferably their branched alkyl moieties are characterized by a weight average carbon number ranging from about 9 to about 14, more preferably from about 10 to about 13, and most preferably from about 11 to about 13.

The BAS surfactants of the present invention may exist in an acid form, while the acid form may be neutralized to form a salt. Typical agents for neutralization include metal counterion bases, such as hydroxides, e.g., NaOH or KOH. Further suitable agents for neutralizing anionic surfactants in their acid forms include ammonia, amines, or alkanolamines. Non-limiting examples of alkanolamines include monoethanolamine, diethanolamine, triethanolamine, and other linear or branched alkanolamines known in the art; suitable alkanolamines include 2-amino-1-propanol, 1-aminopropanol, monoisopropanolamine, or 1-amino-3-propanol. Amine neutralization may be done to a full or partial extent, e.g., part of the anionic surfactant mix may be neutralized with sodium or potassium and part of the anionic surfactant mix may be neutralized with amines or alkanolamines.

In a preferred but not necessary embodiment of the present invention, the BAS surfactants have the general formula (I):

(I)

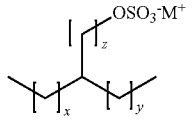

while M is a cation of alkali metal, alkaline earth metal, ammonium, amine or alkanolamine; x and y are independently selected from integers ranging from 0 to about 10; z is an integer ranging from about 1 to about 4; the sum of x+y is equal to or greater than z; and the sum of x+y+z ranges from about 3 to about 11. Preferably, z is about 1, and the sum of x+y is from about 8 to about 9.

Non-limiting examples of suitable branched, unalkoxylated AS surfactants of the present invention include those having the following chemical structures:

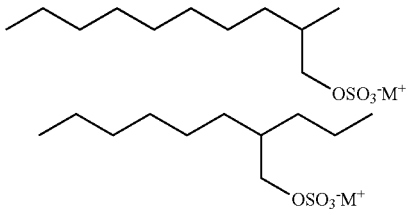

-continued

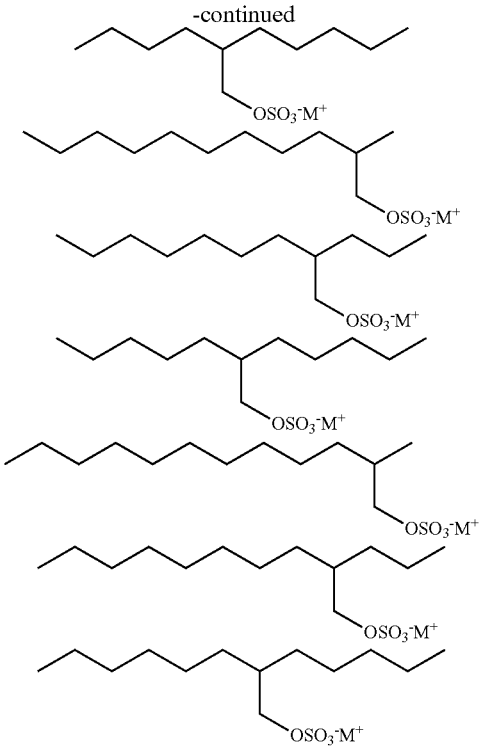

It is particularly preferred that the cleaning composition of the present invention contains a mixture of two or more BAS surfactants. More preferably, such a mixture includes: (1) a $C_{12}$ BAS surfactant in the amount ranging from about 20% to about 80%, preferably from about 30% to about 70%, and more preferably from about 35% to about 50%, by total weight of the mixture; and (2) a $C_{13}$ BAS surfactant in the amount ranging from about 20% to about 80%, preferably from about 30% to about 70%, and more preferably from about 35% to about 50%, by total weight of the mixture. Most preferably, the mixture is consisting of or consisting essentially of the $C_{12}$ and $C_{13}$ BAS surfactants.

BAS surfactants as described hereinabove are commercially available as a mixture of linear isomer and branched isomer with a variety of chain lengths and degrees of branching, which include but are not limited to sulphated Isalchem® 123 from Sasol with $C_{12-13}$ chain length distribution and about 95% branching, and Neodol® 123 AS from Shell with $C_{12-13}$ chain length distribution and about 20% branching.

The cleaning composition of the present invention must contain the above-described BAS surfactants at a sufficiently high level, i.e., from about 10% to about 50% by total weight of the cleaning composition. If the BAS surfactants are present in a level below 10% by total weight of the cleaning composition, the resulting cleaning composition demonstrates poorer suds stability during the wash cycle, which in turn leads to significantly lower Suds Mileage (i.e., below 20 cm). Therefore, it is important to use the BAS surfactants at a sufficiently high level.

Preferably, the BAS surfactants are present in an amount ranging from about 11% to about 30%, preferably from about 12% to about 20%, by total weight of the cleaning composition. In more concentrated formulations with 2×, 3×, or 4× compaction ratios, the BAS surfactants may be present in higher amounts ranging from 30% to 50%, preferably from 35% to 45%, and more preferably from 40% to 45% by weight of the concentrated formulations.

The cleaning composition of the present invention must be substantially free of alkoxylated alkyl sulfate (AxS) surfactants, either linear or branched. Preferably, the cleaning composition of the present invention is essentially free of any AxS. The presence of AxS, even at a level as low as 1 wt %, may significantly affect the Rinse Suds Reduction Rate. An insignificant amount of AxS (e.g., no more than 0.5 wt %), however, seems to be tolerable.

The surfactant system of the present invention may comprise one or more co-surfactants for the BAS surfactants described hereinabove. One type of co-surfactants particularly suitable for the practice of the present invention are linear, unalkoxylated $C_6$-$C_{20}$ alkyl sulfate surfactants, which are hereinafter referred to as "AS" surfactants. The AS surfactants of present invention have the general formula of $R—O—SO_3^-M^+$, wherein R is a linear alkyl group having from about 6 to about 20 carbon atoms, and wherein M is a cation of alkali metal, alkaline earth metal or ammonium. Preferably, the AS surfactants are what are typically referred to as "Mid-Cut AS" or "MCAS" surfactants with R groups having from about 6 to about 16 carbon atoms, more preferably from about 12 to about 16 carbon atoms. R is essentially free of any of any alkoxylation units. MCAS surfactants are particularly advantageous in providing an improved sudsing profile with better rinse benefit.

As mentioned hereinabove, the cleaning composition of the present invention is substantially free of alkoxylated alkyl sulfate (AxS) surfactants, either linear or branched, due the negative impact of the AxS surfactants on the sudsing profile, especially on the rinse suds reduction rate.

Preferably, the AS surfactants are enriched with $C_6$-$C_{14}$, i.e., they contain from 80% to 100%, preferably from 85% to 100%, and more preferably from 90% to 100%, by weight of one or more linear, unalkoxylated $C_6$-$C_{14}$ alkyl sulfate surfactants. More preferably, the AS surfactants are enriched with $C_{8-14}$, i.e., they contain from 80% to 100%, preferably from 85% to 100%, and more preferably from 90% to 100%, by weight of one or more linear, unalkoxylated $C_8$-$C_{14}$ alkyl sulfate surfactants. Still more preferably, the AS surfactants are enriched with $C_{10-14}$, i.e., they contain from 80% to 100%, preferably from 85% to 100%, and more preferably from 90% to 100%, by weight of one or more linear, unalkoxylated $C_{10-14}$ alkyl sulfate surfactants. Most preferably, the AS surfactants are enriched with $C_{12-14}$, i.e., they contain from 80% to 100%, preferably from 85% to 100%, and more preferably from 90% to 100%, by weight of one or more linear, unalkoxylated $C_{12-14}$ alkyl sulfate surfactants.

In a particularly preferred embodiment of the present invention, the AS surfactants are enriched with $C_{12}$, i.e., they comprise from 30% to 100%, more preferably from 50 to 99% or from 60 to 95% or from 65 to 90%, and most preferably from 70 to 80% by weight of a linear, unalkoxylated $C_{12}$ alkyl sulfate surfactant.

The AS surfactants of the present invention may also be particularly enriched with $C_{14}$, i.e., containing from 10% to 100%, or from 20 to 50%, or even from 25 to 30% by weight of a linear, unalkoxylated $C_{14}$ alkyl sulfate surfactant.

The AS surfactants of the present invention may comprise more than 50%, in particular more than 60%, for example more than 70%, typically more than 80 or 90%, or substantially 100% of alkyl sulphate surfactants having an alkyl chain comprising an even number of carbon atoms.

In a preferred but non-limiting embodiment of the present invention, the cleaning composition contains a mixture of two or more AS surfactants. More preferably, such a mixture includes: (1) a linear, unalkoxylated $C_{12}$ alkyl sulfate surfactant in the amount ranging from 30% to 100%, preferably from 50% to 95%, and more preferably from 65% to 80%, by total weight of the mixture; (2) a linear, unalkoxylated $C_{14}$ alkyl sulfate surfactant in the amount ranging from 0% to 70%, preferably from 5% to 50%, and more preferably from 20% to 30%, by total weight of the mixture; and (3) a linear, unalkoxylated $C_{16}$ alkyl sulfate surfactant in the amount ranging from 0% to 30%, preferably from 1% to 20%, and more preferably from 4% to 10% by total weight of the mixture. It is still more preferred that this mixture contains less than 10%, preferably less than 5%, and more preferably less than 2% of alkyl sulfate surfactants having either 18 carbon atoms or more, or 10 carbon atoms or less, by total weight of the mixture.

The AS surfactants of the present invention may be obtained by the sulfonation of the corresponding alcohol(s). The required carbon chain length distribution can be obtained by using alcohols with the corresponding chain length distribution prepared synthetically or from natural raw materials or corresponding pure starting compounds. For example, palm kernel oil and coconut oil comprising triglycerides can be chemically processed to obtain a mixture of $C_{12}$-$C_{18}$ alcohols which usually comprise more than 20% of $C_{16}$-$C_{18}$ alcohols. The alcohols may be sulphated to obtain alkyl sulphates. A mixture of AS comprising a lower proportion of $C_{16}$-$C_{18}$ alkyl sulphates may be obtained by separating the corresponding alcohols before the sulphatation step or by separating the obtained alkyl sulphate surfactant(s) after the sulphatation step.

The AS surfactants of the present invention can also be formed by using metathesis oils that are naturally derived, which can provide a mixture of AS surfactants with alkyl chain lengths characterized by a biologically determined distribution. For example, soybean oil, canola oil, jatropha oil, palm oil, algae oil, or the like can be co-metathesized with 3-hexene to form a mixture containing mostly $C_{12}$ esters. It is also preferred that algae oil of high stability with a desired fatty acid distribution, which can be produced by recombinant DNA technology as described in various patents assigned to Solazyme, is used to form the AS surfactants of the present invention. Alternatively, the above described naturally-derived oils can be co-metathesized with 3-hexene and 2-hexene to form a mixture of $C_{11}$, $C_{12}$, $C_{13}$ esters with a weight ratio of approximately 1:2:1. Alternatively, the above described naturally-derived oils can be co-metathesized with 3-hexene and 4-octene to form a mixture containing mainly $C_{12}$ and $C_{13}$ esters in any desired weight ratio (by controlling the 3-hexene and 4-octene mix ratio). Alternatively, the above described naturally-derived oils can be co-metathesized with a mixture containing 70 wt % 1-butene and 30 wt % hexane to form a mixture of $C_{12}$ and $C_{14}$ fatty acid esters at a weight ratio of approximately 70:30 (there will be small amount of $C_{13}$ and $C_{15}$ esters in the mixture). The esters so formed are then reduced to fatty alcohols, which is subsequently sulfated to form the AS surfactants of the present invention.

If present, the AS surfactants as described hereinabove may be present in the cleaning composition of the present invention in an amount ranging from about 0.5% to about 30%, preferably from about 1% to about 20%, more preferably from about 2% to about 15%, and most preferably from about 3% to about 10%, by total weight of the cleaning composition. In a most preferred embodiment of the present invention, the cleaning composition contains from about 3% to about 5 wt % of an AS surfactant mixture consisting essentially of from about 70 wt % to about 80 wt % of $C_{12}$ AS and from 20 wt % to about 30 wt % of $C_{14}$ AS.

A suitable example of such AS surfactant mixture according to the present invention is Texapon v95 by Cognis. Alternatively, the AS surfactant is the so-called coco-AS, which is derived from coconut oil and contains a mixture of AS surfactants, such as sodium caprylic sulfate, sodium capric sulfate, sodium lauryl sulfate, sodium myristyl sulfate, sodium oleic sulfate, sodium stearyl sulfate, and others.

In more concentrated formulations with 2×, 3×, or 4× compaction ratios, the AS surfactants may be present in higher amounts ranging from 15% to 40%, and preferably from 25% to 35%, by weight of the concentrated formulations.

The weight ratio of the BAS surfactants to the AS surfactants is preferably in the range of from about 10:1 to about 1.5:1, more preferably from about 5:1 to about 2:1, and most preferably from 5:1 to 4:1.

The surfactant system of the present invention may contain one or more additional surfactants, other than the BAS and/or the AS surfactants described hereinabove, as long as such additional surfactants do not adversely affect the sudsing profile established by the BAS and/or AS surfactants, or otherwise interfere with functionalities thereof. Such additional surfactants may be selected from other anionic surfactants, nonionic surfactants, cationic surfactants, zwitterionic surfactants, amphoteric surfactants, and mixtures thereof. Such additional surfactants may be present in the surfactant system of the present invention in a total amount ranging from 0% to about 45% by total weight of the composition, preferably from about 1% to about 30%, more preferably from about 2% to about 25%.

Cleaning Composition

As used herein the phrase "cleaning composition" or "detergent composition" includes compositions and formulations designed for cleaning soiled material. Such compositions include but are not limited to, laundry cleaning compositions and detergents (either with the typical surfactant activity or in a concentrated form with significantly higher surfactant activity), fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, dish washing compositions, hard surface cleaning compositions, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation. The cleaning compositions may have a form selected from liquid, powder, single-phase or multi-phase unit dose, pouch, tablet, gel, paste, bar, or flake.

Because the surfactant system itself provides the desired sudsing benefit, the cleaning composition of the present invention does not require any suds suppressors, such as silicone antifoam or suds collapsing polymers, which functions to minimize the manufacturing and processing costs associated with such cleaning composition. In a preferred embodiment of the present invention, the cleaning composition is substantially free of, and preferably is essentially free of, silicone suds suppressor. In a more preferred embodiment of the present invention, the cleaning composition is substantially free of, or essentially free of, any suds suppressor.

The cleaning composition of the present invention can be formulated or designed either as an automatic machine wash detergent product, or a semi-automatic detergent product, or a hand-wash detergent product. Due to the improved sudsing profile of such composition, which is most visible to the consumers during hand-wash, it is preferred that it is a detergent product specifically designed for hand-wash, in order to highlight its sudsing benefit and delight the consumer.

In a preferred but not necessary embodiment of the present invention, the cleaning composition is a granular or powder detergent composition, more preferably a granule or powder laundry detergent composition, having a density ranging from 250 g/l to about 1000 g/1, more preferably from about 300 g/l to about 900 g/1, and most preferably from about 400 g/l to about 850 g/1. The powder or granular detergent may comprise: (a) from 0.1% to 40%, preferably from 0.5% to 30%, and more preferably from 3% to 25%, of a water-soluble alkali metal carbonate (such as sodium carbonate), by totally weight of such granular detergent composition; and/or (b) from 10% to 95%, preferably from 20% to 90%, and more preferably from 30% to 80%, of a water-soluble alkali metal sulfate (such as sodium sulfate), by total weight of the granular detergent composition; and/or (c) from about 10% to about 95%, preferably from about 20% to about 90%, and more preferably from about 30% to about 80%, of a water-soluble alkali metal chloride (such as sodium chloride), by totally weight of such granular detergent composition. Such a granule laundry detergent composition may further comprise one or more adjunct ingredients commonly used for formulating granular laundry detergent compositions, such as builders, carriers, structurants, flocculating aid, chelating agents, dye transfer inhibitors, enzymes, enzyme stabilizers, catalytic materials, bleach activators, hydrogen peroxide, sources of hydrogen peroxide, preformed peracids, polymeric dispersing agents, clay soil removal/anti-redeposition agents, brighteners, suds suppressors, dyes, perfumes, structure elasticizing agents, fabric softeners, hydrotropes, processing aids, pigments and/or aesthetic particles.

The powder or granular detergent composition preferably comprises only low levels of phosphate or zeolite builders, or more preferably it is substantially free of, or most preferably it is completely free of, phosphate or zeolite builders.

In a particularly preferred, but not necessary, embodiment of the present invention, a granular laundry detergent composition is provided, which contains: (1) from about 10 wt to about 30 wt % of BAS; (2) from 0 wt % to 0.5 wt % of AxS; and (3) one or more additional ingredients.

In another preferred but not necessary embodiment of the present invention, a granular laundry detergent composition contains: (1) from about 10 wt to about 15 wt % of BAS; (2) from about 1 wt % to about 5 wt % of AS, which is preferably MCAS; (3) from 0 wt % to 0.5 wt % of AxS; and (4) one or more additional ingredients.

In another embodiment of the present invention, the cleaning composition is a liquid detergent composition, preferably a liquid laundry detergent composition, having a viscosity ranging from about 200 to about 800 mPa·s measured at 25° C. at a shear rate of 20 $sec^{-1}$. The liquid detergent composition may be packaged in a single phase or multiphase unit dose form, i.e., it is contained in a single compartment or multi-compartment water-soluble pouch formed, for example, by a water-soluble polymer such as polyvinyl alcohol (PVA) and/or polyvinylpyrrolidone (PVP).

The liquid detergent composition of the present invention may further comprise, in addition to the ingredients described hereinabove, from about 0.1% to about 10%, preferably from about 0.5% to about 8%, and more preferably from about 1% to about 5% of one or more acids, such as citric acid, boric acid, and mixture thereof, by total weight of the liquid detergent composition. Preferably, the liquid detergent composition contains from about 1 wt % to about 3 wt % of citric acid and/or from about 1 wt % to about 3 wt % of boric acid. In addition, fatty acids, particularly $C_{12}$-$C_{18}$ fatty acids, or salts thereof can be included in the liquid laundry detergent composition of the present invention. The total amount of such fatty acids or salts may range from about 0.1 wt % to about 5 wt %, preferably from about 0.5 wt % to about 4 wt %, and more preferably from about 0.7 wt % to about 3 wt %.

The liquid detergent composition of the present invention typically contains one or more carriers, such as water. It can contain either water alone as the sole carrier, or mixtures of organic solvent(s) with water as carriers. Suitable organic solvents are linear or branched lower $C_1$-$C_8$ alcohols, diols, glycerols or glycols; lower amine solvents such as $C_1$-$C_4$ alkanolamines, and mixtures thereof. Particularly preferred organic solvents include 1,2-propanediol, ethanol, glycerol, monoethanolamine and triethanolamine. The carriers are typically present in the liquid detergent composition of the present invention at levels in the range of from about 10% to about 95%, preferably from about 25% to about 75%, by total weight of the liquid detergent composition. In some embodiments, water is from about 85 to about 100 wt % of the carrier. In other embodiments, water is absent and the composition is anhydrous. Highly preferred compositions afforded by the present invention are clear, isotropic liquids.

In a particularly preferred, but not necessary, embodiment of the present invention, a liquid laundry detergent composition is provided, which contains: (1) from about 10 wt to about 30 wt % of BAS; (2) from 0 wt % to 0.5 wt % of AxS; and (3) one or more additional ingredients.

In another preferred but not necessary embodiment of the present invention, a liquid laundry detergent composition contains: (1) from about 10 wt to about 15 wt % of BAS; (2) from about 1 wt % to about 5 wt % of AS, which is preferably MCAS; (3) from 0 wt % to 0.5 wt % of AxS; and (4) one or more additional ingredients.

In a further preferred but not necessary embodiment of the present invention, the cleaning composition is in a unit dose form, which contains a liquid laundry detergent encapsulated within a water-soluble film. Preferred film materials are preferably polymeric materials selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected polyvinyl alcohols, polyvinyl alcohol copolymers and hydroxypropyl methyl cellulose (HPMC), and combinations thereof.

The cleaning compositions of the invention may also contain one or more adjunct cleaning additives. Suitable adjunct cleaning additives include builders, fillers, carriers, structurants or thickeners, clay soil removal/anti-redeposition agents, polymeric soil release agents, polymeric dispersing agents, polymeric grease cleaning agents, enzymes, enzyme stabilizing systems, amines, bleaching compounds, bleaching agents, bleach activators, bleach catalysts, brighteners, dyes, hueing agents, dye transfer inhibiting agents, chelating agents, softeners or conditioners (such as cationic polymers or silicones), perfumes (including perfume encapsulates), hygiene and malodor treatment agents, and the like.

More specifically, the adjunct cleaning additives may include: transition metal catalysts; imine bleach boosters; enzymes such as amylases, carbohydrases, cellulases, laccases, lipases, bleaching enzymes such as oxidases and peroxidases, proteases, pectate lyases and mannanases; source of peroxygen such as percarbonate salts and/or perborate salts, preferred is sodium percarbonate, the source of peroxygen is preferably at least partially coated, preferably completely coated, by a coating ingredient such as a carbonate salt, a sulphate salt, a silicate salt, borosilicate, or mixtures, including mixed salts, thereof; bleach activator such as tetraacetyl ethylene diamine, oxybenzene sulphonate bleach activators such as nonanoyl oxybenzene sulphonate, caprolactam bleach activators, imide bleach activators such as N-nonanoyl-N-methyl acetamide, preformed peracids such as N,N-pthaloylamino peroxycaproic acid, nonylamido peroxyadipic acid or dibenzoyl peroxide; brighteners; hueing agents; photobleach; fabric-softening agents such as clay, silicone and/or quaternary ammonium compounds; flocculants such as polyethylene oxide; dye transfer inhibitors such as polyvinylpyrrolidone, poly 4-vinylpyridine N-oxide and/or co-polymer of vinylpyrrolidone and vinylimidazole; fabric integrity components such as oligomers produced by the condensation of imidazole and epichlorhydrin; soil dispersants and soil anti-redeposition aids such as alkoxylated polyamines and ethoxylated ethyleneimine polymers; anti-redeposition components such as polyesters and/or terephthalate polymers, polyethylene glycol including polyethylene glycol substituted with vinyl alcohol and/or vinyl acetate pendant groups; perfumes such as perfume microcapsules, polymer assisted perfume delivery systems including Schiff base perfume/polymer complexes, starch encapsulated perfume accords; soap rings; aesthetic particles including coloured noodles and/or needles; dyes; fillers such as sodium sulphate, although it may be preferred for the composition to be substantially free of fillers; carbonate salt including sodium carbonate and/or sodium bicarbonate; silicate salt such as sodium silicate, including 1.6R and 2.0R sodium silicate, or sodium metasilicate; co-polyesters of di-carboxylic acids and diols; cellulosic polymers such as methyl cellulose, carboxymethyl cellulose, hydroxyethoxycellulose, or other alkyl or alkylalkoxy cellulose, and hydrophobically modified cellulose; carboxylic acid and/or salts thereof, including citric acid and/or sodium citrate; and any combination thereof.

A wide variety of other ingredients may be used in the cleaning compositions herein, including other active ingredients, carriers, hydrotropes, processing aids, dyes or pigments, solvents for liquid formulations, and solid or other liquid fillers, erythrosine, colliodal silica, waxes, probiotics, surfactin, aminocellulosic polymers, zinc ricinoleate, perfume microcapsules, rhamnolipids, sophorolipids, glycopeptides, methyl ester sulfonates, methyl ester ethoxylates, sulfonated estolides, cleavable surfactants, biopolymers, silicones, modified silicones, aminosilicones, deposition aids, locust bean gum, cationic hydroxyethylcellulose polymers, cationic guars, hydrotropes (especially cumenesulfonate salts, toluenesulfonate salts, xylenesulfonate salts, and naphalene salts), antioxidants, BHT, PVA particle-encapsulated dyes or perfumes, pearlescent agents, effervescent agents, color change systems, silicone polyurethanes, opacifiers, tablet disintegrants, biomass fillers, fast-dry silicones, glycol distearate, hydroxyethylcellulose polymers, hydrophobically modified cellulose polymers or hydroxyethylcellulose polymers, starch perfume encapsulates, emulsified oils, bisphenol antioxidants, microfibrous cellulose structurants, properfumes, styrene/acrylate polymers, triazines, soaps, superoxide dismutase, benzophenone protease inhibitors, functionalized TiO2, dibutyl phosphate, silica perfume capsules, and other adjunct ingredients, silicate salts (e.g., sodium silicate, potassium silicate), choline oxidase, pectate lyase, mica, titanium dioxide coated mica, bismuth oxychloride, and other actives.

The cleaning compositions described herein may also contain vitamins and amino acids such as: water soluble vitamins and their derivatives, water soluble amino acids and their salts and/or derivatives, water insoluble amino acids viscosity modifiers, dyes, nonvolatile solvents or diluents (water soluble and insoluble), pearlescent aids, foam boosters, additional surfactants or nonionic cosurfactants, pediculocides, pH adjusting agents, perfumes, preservatives, chelants, proteins, skin active agents, sunscreens, UV absorbers, vitamins, niacinamide, caffeine, and minoxidil.

The cleaning compositions of the present invention may also contain pigment materials such as nitroso, monoazo, disazo, carotenoid, triphenyl methane, triaryl methane, xanthene, quinoline, oxazine, azine, anthraquinone, indigoid, thionindigoid, quinacridone, phthalocianine, botanical, and natural colors, including water soluble components such as those having C.I. Names. The cleaning compositions of the present invention may also contain antimicrobial agents.

Methods of Use

The present invention includes methods for cleaning soiled material using the cleaning compositions of the present invention. As will be appreciated by one skilled in the art, the cleaning compositions of the present invention are suited for use in laundry pretreatment applications, laundry cleaning applications, and home care applications.

Preferably, such a method is a method of using the detergent compositions of the present invention to clean soiled material, which includes, but are not limited to, the steps of providing a detergent composition as described hereinabove (either in neat form or diluted in a wash liquor), contacting such detergent composition with at least a portion of a soiled material, and then rinsing the soiled material.

For use in laundry pretreatment applications, the method may include contacting the cleaning compositions described herein with soiled fabric. Following pretreatment, the soiled fabric may be laundered in a washing machine or otherwise rinsed.

The cleaning compositions of the present invention are particular suitable for hand washing applications, or combined hand washing with semi-automatic washing machines.

Specifically, the consumers directly bring the soiled material into contact with the cleaning compositions, manually or semi-manually clean the soiled material, and then rinse off the soiled material in one or more rinse cycles.

Alternatively, the cleaning compositions of the present invention are suitable for machine laundry methods, which may comprise treating soiled laundry with an aqueous wash solution in a washing machine having dissolved or dispensed therein an effective amount of a machine laundry cleaning composition in accord with the invention.

Another method includes contacting a nonwoven substrate impregnated with an embodiment of the cleaning composition with soiled material. As used herein, "nonwoven substrate" can comprise any conventionally fashioned nonwoven sheet or web having suitable basis weight, caliper (thickness), absorbency, and strength characteristics. Non-limiting examples of suitable commercially available non-woven substrates include those marketed under the tradenames SONTARA® by DuPont and POLYWEB® by James River Corp.

An "effective amount" of the cleaning composition means from about 10 g to about 300 g of product dissolved or dispersed in a wash solution of volume from about 5 L to about 65 L. The water temperatures may range from about 5° C. to about 100° C. The water to soiled material (e.g., fabric) ratio may be from about 1:1 to about 30:1. The compositions may be employed at concentrations of from about 500 ppm to about 15,000 ppm, preferably from about 1000 ppm to about 10,000 ppm and more preferably from about 3000 ppm to about 5000 ppm, in solution. In the context of a fabric laundry composition, usage levels may also vary depending not only on the type and severity of the soils and stains, but also on the wash water temperature, the volume of wash water, as well as the type of washing machine (e.g., top-loading, front-loading, top-loading, vertical-axis Japanese-type automatic washing machine).

The cleaning compositions herein may be used for laundering of fabrics at reduced wash temperatures. These methods of laundering fabric comprise the steps of delivering a laundry cleaning composition to water to form a wash liquor and adding a laundering fabric to said wash liquor, wherein the wash liquor has a temperature of from about 0° C. to about 20° C., or from about 0° C. to about 15° C., or from about 0° C. to about 9° C. The fabric may be contacted to the water prior to, or after, or simultaneous with, contacting the laundry cleaning composition with water.

Test Methods

Various techniques are known in the art to determine the properties of the compositions of the present invention comprising the branched AS surfactant and the short-chain nonionic AA surfactant. However, the following assays must be used in order that the invention described and claimed herein may be fully understood.

Test 1: Sudsing Profile Test (for Determining Various Sudsing Parameters)

Sudsing profile of test detergent compositions herein is measured by employing a suds cylinder tester (SCT). The SCT has a set of eight (8) cylinders. Each cylinder is a plastic cylinder about 66 cm long that has uniform inner diameter of 50 mm through its length and can be capped or sealed by a rubber stopper during rotation. The 8 cylinders are all attached to a horizontal axis at the middle part of each cylinder. All 8 cylinders are arranged perpendicular to the horizontal axis but parallel to one another. The cylinders are spaced apart with equal distances in between, and they may be rotated together the around the horizontal axis along a vertical plan that is perpendicular to the horizontal axis at a speed of 20-22 revolutions per minute (rpm).

The following factors may affect the measurement results and therefore should be controlled carefully: (a) concentration of the test detergent composition in the washing solution and rinsing solution; (b) hardness of the water used to form the washing and rinsing solution; (c) water temperature; (d) speed and number of rotations of the SCT cylinders; (e) type of soil used and the total soil load used in the wash; and (f) cleanness of the interior of the SCT cylinders.

Following steps are followed to obtain the suds measurements for each test detergent composition:

1. Weigh 1.5 grams of the test detergent composition (either in granular or liquid form) and dissolve it in 300 ml of reverse-osmosis (RO) water with a water hardness level of about 16 gpg (Ca/Mg 4:1 formed by mixing 21.9 mg/L $CaCl_2.2H_2O$ and 111.3 mg/L $MgCl_2.6H_2O$) at room temperature;
2. Stir the mixture for at least 15 minutes to form a sample wash solution containing the test detergent composition at 5000 ppm;
3. Pour the sample solution into to a SCT cylinder, close it tightly with a rubber stopper and lock the cylinder in place ready for rotation. Other SCT cylinders can be filled with sample solutions formed by using other test detergent compositions for simultaneous suds measurement of different test detergent compositions;
4. Turn on the SCT to rotate the cylinders for 10 revolutions at a speed of 22 rpm;
5. Stop the SCT rotation and lock the SCT cylinders in an upright position;
6. Wait for 1 minute before recording the suds volume (represented by the absolute suds height) in each SCT cylinder, which is deemed the suds volume generated by the test detergent composition at 10 revolutions. Because all SCT cylinders have the same interior diameter, the suds volume at any given point can therefore be simply represented by the absolute height of the suds in centimeters (cm) inside each SCT cylinder, which is measured by subtracting the height of the wash or rinse solution from the total height of the suds plus the wash or rinse solution.
7. Turn on the SCT to continue rotation of the cylinders for additional 20 revolutions at a speed of 22 rpm, stop the SCT and record suds volume as that at 30 revolutions;
8. Repeat Step 7 to record suds volume at 50 and 70 revolutions at a speed of 22 rpm;
9. Stop the SCT rotation, remove the rubber stoppers from the cylinders, and place 1 piece of fabric loaded with Beijing clay (BJ Clay) and 1 piece of fabric loaded with dirty cooking oil (DCO), the preparation of which is described hereinbelow, into each SCT cylinder.

Preparation of Fabric Loaded with BJ Clay:

Disperse 20 g of BJ Clay (collected from 15 cm below the earth surface in Beijing, China and then dried at the room temperature for 1-2 weeks, followed by blending in a heavy duty blender and meshing through 150-200# sieves) into 80 ml of deionized water via agitation to make a clay suspension. Alternatively, Arizona clay (i.e., Arizona Test Dust with a median particle size of about 0.889 micron and a mean particle size of about 0.942 micron from Powder Technology Inc. in the United States) can be used in place of BJ Clay;

Keep agitating the clay suspension, while brushing 2 g of such clay suspension onto the center of a 10 cm×10 cm piece of CW98 white cotton knit (100%) fabric supplied by DaXinFangZHi (Beijing, China) to form a round shape stain with a diameter of about 5 cm; and The cotton fabric is then left to dry at room temperature before used.

Preparation of Fabric Loaded with DCO:

Use 100 g of peanut oil to fry 20 g of salty fish for 2 hours at 150-180° C. to form DCO.

Pipette 0.6 ml of the DCO onto the center of the 10 cm×10 cm cotton fabric described hereinabove to form a round shape stain with a diameter of about 5 cm.

Cut the cotton fabric into 2 equal pieces and use 1 piece for each performance evaluation.

10. Place the rubber stoppers back onto the SCT cylinders.
11. Turn on the SCT to continue rotation of the cylinders for additional 40 revolutions at a speed of 22 rpm, stop the SCT and record suds volume as that of 110 revolutions.
12. Repeat Steps 9-11, and record the suds volume as that of 150 revolutions. Note that further addition of soiled fabrics into the wash solutions in the SCT cylinders is to mimic real washing conditions where more soil is gradually dissolved into the washing solution from the fabrics as the washing cycle continues. Therefore, this test is relevant for determining the initial suds generation by a test detergent composition, as well as the suds mileage sustained through the washing cycle while more soil is gradually dissolved into the washing solution.
13. Pour 37.5 ml of the sample wash solution (without any of the treated fabric pieces) gently out of the SCT cylinder into a 300 ml beaker. Add 262.5 ml of RO water with a water hardness level of 16 gpg (Ca/Mg 4:1) into the beaker to form a diluted solution with a total volume of 300 ml (referred to as the "Rinse Solution"). Dispose of the remaining test solution and all the stained fabric swatches from the SCT cylinder and clean the SCT cylinder with tap water. Pour the 300 ml Rinse Solution from the beaker back into the cleaned SCT cylinder. Repeat these steps for each of the test solutions contained in each of the remaining SCT cylinders.
14. Turn on the SCT to continue rotation of the cylinders for additional 20 revolutions at a speed of 22 rpm and stop the SCT. Take a picture right after the SCT is stopped and read the suds height from the picture (this is done to ensure data accuracy due to the very rapid collapsing of suds in the inventive samples), which is recorded as the suds volume at 0 minute after 170 revolutions. This suds data is taken after the wash solution is replaced by the Rinse Solution, and is therefore recorded as the "Rinse Suds at 0 Minute."
15. Another reading of the suds volume in the SCT cylinders is taken 1 minute after the SCT is stopped at 170 revolutions (which is referred to as the "Rinse Suds at 1 Minute").
16. The suds reduction rate from 0 minute to 1 minute during the first rinse with the Rinse Solution is calculated as follows:

$$\text{Rinse Suds Reduction Rate (\%/min)} = \left(\frac{\text{Rinse Suds at 0 Min} - \text{Rinse Suds at 1 Min}}{\text{Rinse Suds at 0 Min}}\right) \times \frac{100}{1\ \text{Min}}$$

17. Following are the sudsing data recorded by this test method:

| | | |
|---|---|---|
| Initial Wash Suds Volume (cm) | Average of the suds volume (measured by height) data recorded at 10, 30, 50, and 70 revolutions (representing the W-1 stage) | Washing Cycle: Wash data analysis is focused on "Flash Suds" generation during the W-1 stage and "Suds Mileage" through the wash during the W-2 stage. |
| Suds Mileage (cm) | Average of the suds volume (measured by height) data recorded at 110 and 150 revolutions (representing the W-2 stage) | |
| Wash Suds Retention Percentage (%) | $= \frac{\text{Suds Mileage}}{\text{Initial Wash Suds Volume}} \times 100$ | |
| 1/8 Rinse Suds at 0 Minute(cm) | Suds volume (measured by height) data recorded at 0 minute after 170 revolutions (representing the R-1 stage) | Rinsing Cycle: Rinse data analysis is focused on "Initial Rinse Suds" measured during the R-1 stage, and "End Rinse Suds" measured at the R-2 stage. The Rinse Suds Reduction Rate derives from and therefore jointly evaluates these two data points. |
| 1/8 Rinse Suds at 1 Minute (cm) | Suds volume (measured by height) data recorded at 1 minute after 170 revolutions (representing the R-2 stage) | |
| Rinse Suds Reduction Rate (%/min) | Suds reduction rate from 0 minute to 1 minute during the first rinse (1/8 Rinse). | |

EXAMPLES

Example 1: Comparative Tests Showing Impact of BAS and Ethoxylated Alkyl Sulfate (AES) Concentrations on Sudsing Profiles of Granular Laundry Detergent Formulations The following four (4) granular laundry detergent formulations A-D are prepared according to the present invention.

TABLE 1

| Ingredients* (wt %) | A | B | C | D |
|---|---|---|---|---|
| BAS[1] | 7 | 12 | 12 | 12 |
| $AE_{1.8}S$ | — | — | 0.2 | 1 |
| Carboxymethyl Cellulose | 0.19 | 0.19 | 0.19 | 0.19 |
| Acrylic acid/maleic acid copolymer | 1.84 | 1.84 | 1.84 | 1.84 |
| Polyethylene glycol-Polyvinyl acetate graft polymer | 0.29 | 0.29 | 0.29 | 0.29 |
| Silicate (2.35R) | 2.83 | 2.83 | 2.83 | 2.83 |
| Sodium carbonate | 17.28 | 17.28 | 17.28 | 17.28 |
| Sodium sulfate | Q.S. | Q.S. | Q.S. | Q.S. |
| Total | 100 | 100 | 100 | 100 |

*Note that all ingredient concentrations in this example and all other examples are the concentrations of the pure materials in the final composition, not the concentrations of the raw materials added, unless otherwise specified.

[1]Isalchem ® 123, which is a mixture of branched, unalkoxylated $C_{12}$-$C_{13}$ alkyl sulfates commercially available from Sasol. It contains more than 40% of $C_{12}$ AS and more than 40% of $C_{13}$ AS, both branched and unalkoxylated and having at least 90% branching. It is provided as a 75% active raw material with 0.6% of NaOH, 0.8% of sodium sulfate, 1-1.3% $C_{12}$-$C_{13}$ residue alcohol carried over from the synthesis of the alkyl sulfate, and balance water.

Among these 4 granular formulations, Formulations A and D are comparative examples outside of the scope of the present invention. Specifically, Formulation A contains 7% of the BAS surfactants (i.e., too low), and Formulation D contains 1% of AES (too high). Formulations B and C are inventive examples within the scope the present invention, i.e., both containing 12% of the BAS surfactants and no more than 0.5% of AES.

The sudsing profiles of the above-listed 4 granular laundry detergent formulations A-D are measured by using the method described in Test 1. The measurement results are tabulated as follows:

TABLE 2

| Sudsing Profile | A | B | C | D |
|---|---|---|---|---|
| Initial Wash Suds Volume (cm) | 37.4 | 44.5 | 44.8 | 45.3 |
| Suds Mileage (cm) | 18 | 37.1 | 39.5 | 41 |
| Wash Suds Retention Percentage (%) | 48% | 83% | 88% | 91% |
| ⅛Rinse Suds at 0 Min (cm) | 0 | 1.1 | 2 | 5.4 |
| ⅛Rinse Suds at 1 Min (cm) | 0 | 0 | 0.7 | 3.9 |
| Rinse Suds Reduction Rate (%/min) | 0% | 100% | 65% | 28% |

The data indicates that on one hand, the Comparative Formulation A containing less than 10% of the BAS surfactants has suds stability issue during the wash cycle, as indicated by a very low Suds Mileage (less than 20 cm) as well as a low Wash Suds Retention Percentage (less than 50%). On the other hand, the Comparative Formulation D containing more than 0.5% of AES has insufficient rinse suds reduction, as indicated by a low Rinse Suds Reduction Rate (less than 30%/min).

Example 2: Comparative Tests Showing Impact of BAS and AES Concentrations on Sudsing Profiles of Liquid Laundry Detergent Formulations The following four (4) liquid laundry detergent formulations I-V are prepared according to the present invention.

TABLE 3

| Ingredients (wt %) | I | II | III | IV |
|---|---|---|---|---|
| BAS[1] | 7 | 12 | 12 | 12 |
| $AE_{1.8}S$ | — | — | 0.2 | 1 |
| Citric acid | 2 | 2 | 2 | 2 |
| Chelant (DTPA) | 0.19 | 0.19 | 0.19 | 0.19 |
| 1,2-propanediol | 1.21 | 1.21 | 1.21 | 1.21 |
| Boric acid | 2.1 | 2.1 | 2.1 | 2.1 |
| Polyethyleneimine[2] | 0.46 | 0.46 | 0.46 | 0.46 |
| NaOH | Sufficient to adjust pH to 7.5-8.0 | | | |
| Water | Q.S. | Q.S. | Q.S. | Q.S. |
| Total | 100 | 100 | 100 | 100 |

[1]Isalchem ® 123, which is a mixture of branched, unalkoxylated $C_{12}$-$C_{13}$ alkyl sulfates commercially available from Sasol. It contains more than 40% of $C_{12}$ AS and more than 40% of $C_{13}$ AS, both branched and unalkoxylated and having at least 90% branching. It is provided as a 75% active raw material with 0.6% of NaOH, 0.8% of sodium sulfate, 1-1.3% $C_{12}$-$C_{13}$ residue alcohol carried over from the synthesis of the alkyl sulfate, and balance water.
[2]$PEI_{600}EO_{20}$ having a polyethyleneimine core characterized by a molecular weight of about 600 with EO groups attached thereto, wherein the EO groups have an average degree of ethoxylation of about 20.

Among these 4 liquid formulations, Formulations I and IV are comparative examples outside of the scope of the present invention. Specifically, Formulation I contains 7% of the BAS surfactants (i.e., too low), and Formulation IV contains 1% of AES (too high). Formulations II and III are inventive examples within the scope the present invention, i.e., both containing 12% of the BAS surfactants and no more than 0.5% of AES.

The sudsing profiles of the above-listed 4 liquid laundry detergent formulations I-IV are measured by using the method described in Test 1. The measurement results are tabulated as follows:

TABLE 4

| Sudsing Profile | I | II | III | IV |
|---|---|---|---|---|
| Initial Wash Suds Volume (cm) | 33.6 | 34.7 | 39.4 | 43.4 |
| Suds Mileage (cm) | 19.3 | 34.3 | 39.3 | 44.5 |
| Wash Suds Retention Percentage (%) | 57.4% | 98.8% | 99.7% | 102.5% |
| ⅛Rinse Suds at 0 Min (cm) | 1.5 | 4 | 5.8 | 10.1 |
| ⅛Rinse Suds at 1 Min (cm) | 0 | 0.7 | 2.1 | 10.1 |
| Rinse Suds Reduction Rate (%/min) | 100% | 82.5% | 63.8% | 0% |

The data indicates that on one hand, the Comparative Formulation A containing less than 10% of the BAS surfactants has suds stability issue during the wash cycle, as indicated by a very low Suds Mileage (less than 20 cm) as well as a low Wash Suds Retention Percentage (less than 60%). On the other hand, the Comparative Formulation D containing more than 0.5% of AES shows no rinse suds reduction, as indicated by a 0% Rinse Suds Reduction Rate.

Example 3: Exemplary Granular and Liquid Laundry Detergent Formulations

The following three (3) inventive granular laundry detergent formulations E-G are prepared according to the present invention.

TABLE 5

| Ingredients* (wt %) | E | F | G |
|---|---|---|---|
| BAS[1] | 15 | 15 | 12 |
| $AE_{1.8}S$ | — | 0.2 | — |
| MCAS[2] | — | — | 3 |
| Carboxymethyl Cellulose | 0.19 | 0.19 | 0.19 |
| Acrylic acid/maleic acid copolymer | 1.84 | 1.84 | 1.84 |
| Polyethylene glycol-Polyvinyl acetate graft polymer | 0.29 | 0.29 | 0.29 |
| Silicate (2.35R) | 2.83 | 2.83 | 2.83 |
| Sodium carbonate | 17.29 | 17.28 | 17.28 |
| Sodium sulfate | Q.S. | Q.S. | Q.S. |
| Total | 100 | 100 | 100 |

*Note that all ingredient concentrations in this example and all other examples are the concentrations of the pure materials in the final composition, not the concentrations of the raw materials added, unless otherwise specified.
[1]Isalchem ® 123, which is a mixture of branched, unalkoxylated $C_{12}$-$C_{13}$ alkyl sulfates commercially available from Sasol. It contains more than 40% of $C_{12}$ AS and more than 40% of $C_{13}$ AS, both branched and unalkoxylated and having at least 90% branching. It is provided as a 75% active raw material with 0.6% of NaOH, 0.8% of sodium sulfate, 1-1.3% $C_{12}$-$C_{13}$ residue alcohol carried over from the synthesis of the alkyl sulfate, and balance water.
[2]A mixture of linear, unalkoxylated alkyl sulfates containing about 71% of $C_{12}$ AS, about 23% of C14 AS, about 5% of C16 AS, and less than about 1% of AS with alkyl chain length that is either no more than 10 or no less than 18.

The following three (3) inventive liquid laundry detergent formulations V-VII are prepared according to the present invention.

TABLE 6

| Ingredients (wt %) | V | VI | VII |
|---|---|---|---|
| BAS[1] | 15 | 15 | 12 |
| $AE_{1.8}S$ | — | 0.2 | — |
| MCAS[2] | — | — | 3 |
| Citric acid | 2 | 2 | 2 |
| Chelant (DTPA) | 0.19 | 0.19 | 0.19 |
| 1,2-propanediol | 1.21 | 1.21 | 1.21 |

TABLE 6-continued

| Ingredients (wt %) | V | VI | VII |
|---|---|---|---|
| Boric acid | 2.1 | 2.1 | 2.1 |
| Polyethyleneimine[3] | 0.46 | 0.46 | 0.46 |
| NaOH | Sufficient to adjust pH to 7.5-8.0 | | |
| Water | Q.S. | Q.S. | Q.S. |
| Total | 100 | 100 | 100 |

[1]Isalchem ® 123, which is a mixture of branched, unalkoxylated $C_{12}$-$C_{13}$ alkyl sulfates commercially available from Sasol. It contains more than 40% of $C_{12}$ AS and more than 40% of $C_{13}$ AS, both branched and unalkoxylated and having at least 90% branching. It is provided as a 75% active raw material with 0.6% of NaOH, 0.8% of sodium sulfate, 1-1.3% $C_{12}$-$C_{13}$ residue alcohol carried over from the synthesis of the alkyl sulfate, and balance water.
[2]A mixture of linear, unalkoxylated alkyl sulfates containing about 71% of $C_{12}$ AS, about 23% of C14 AS, about 5% of C16 AS, and less than about 1% of AS with alkyl chain length that is either no more than 10 or no less than 18.
[3]$PEI_{600}EO_{20}$ having a polyethyleneimine core characterized by a molecular weight of about 600 with EO groups attached thereto, wherein the EO groups have an average degree of ethoxylation of about 20.

The sudsing profiles of the above-listed 6 inventive granular or liquid laundry detergent formulations E-G and V-VII are measured by using the method described in Test 1. The measurement results are tabulated as follows:

TABLE 7

| | Powder | | | Liquid | | |
|---|---|---|---|---|---|---|
| Sudsing Profile | E | F | G | V | VI | VII |
| Initial Wash Suds Volume (cm) | 45.3 | 43.8 | 41.5 | 41.2 | 41.3 | 43.9 |
| Suds Mileage (cm) | 41.8 | 41.8 | 38.4 | 37.8 | 38.1 | 41.5 |
| Wash Suds Retention Percentage (%) | 92% | 95% | 93% | 92% | 92% | 95% |
| ⅛ Rinse Suds at 0 Min (cm) | 1.5 | 2.5 | 1.5 | 3.5 | 3.8 | 4.8 |
| ⅛ Rinse Suds at 1 Min (cm) | 0 | 0.7 | 0 | 0.9 | 1.3 | 1.8 |
| Rinse Suds Reduction Rate (%/min) | 100% | 72% | 100% | 74% | 66% | 63% |

The sudsing profiles of the above-listed 6 inventive granular or liquid laundry detergent formulations E-F and V-VII are all within the scope of the present invention. Specifically, they all have: a) an Initial Wash Suds Volume of no less than about 30 cm; b) a Suds Mileage of no less than about 30 cm; c) a Wash Suds Retention Percentage of no less than about 60%; and d) a Rinse Suds Reduction Rate of no less than about 40%/min.

Example 4: Exemplary Powder Laundry Detergent Formulations

Powder laundry detergent compositions 4A-4F are formulated according to the present invention, by mixing together ingredients listed hereinbelow:

| Ingredients (Wt %) | 4A | 4B | 4C | 4D | 4E | 4F |
|---|---|---|---|---|---|---|
| BAS | 10-50 | 12 | 15 | 20 | 25 | 30 |
| $AE_{1.8}S$ (or $AE_3S$) | 0-0.5 | 0.3 | 0.3 | 0 | 0.2 | 0.1 |
| MCAS | 0.1-10 | 1 | 3 | 1 | 3 | 5 |
| LAS | 0.1-10 | 0 | 2 | 5 | 6 | 0 |
| Zeolite | 0-5 | 0 | 0 | 0 | 0-5 | 0-5 |
| Enzymes | 0-2 | 0-2 | 0-2 | 0-2 | 0-2 | 0-2 |
| Polymeric dispersing or soil release agent(s) | 0-2 | 1.84 | 1.84 | 1.68 | 0-2 | 0-2 |
| Bleach and bleach activator | 0-5 | 0 | 0 | 0 | 0-5 | 0-5 |
| Silicate | 0-6 | 3 | 2.69 | 3 | 0-6 | 0-6 |
| Sodium Carbonate | 2-25 | 18 | 16 | 14 | 2-25 | 2-25 |
| Sodium Sulfate | balance | balance | balance | balance | balance | balance |

Example 5: Exemplary Liquid Laundry Detergent Formulations

Liquid laundry detergent compositions 5A-5F are formulated according to the present invention, by mixing together ingredients listed hereinbelow:

| Ingredients (wt %) | 11A | 11B | 11C | 11D | 11E | 11F |
|---|---|---|---|---|---|---|
| BAS | 10-50 | 12 | 15 | 20 | 25 | 30 |
| $AE_{1.8}S$ (or $AE_3S$) | 0-0.5 | 0.3 | 0.3 | 0 | 0.2 | 0.1 |
| MCAS | 0.1-10 | 1 | 3 | 1 | 3 | 5 |
| LAS | 0.1-10 | 0 | 2 | 5 | 6 | 0 |
| Citric Acid | 0-5 | 1.98 | — | 2.62 | 2.62 | 0-8 |
| Boric Acid | 0-3 | 1 | 3 | 2.1 | 0-3 | 0-3 |
| Amine Oxide | 0-1.2 | — | 0.5 | — | 0-1.2 | 0-2 |
| Fatty Acids | 0-2 | 1 | 0 | 1 | 0-4 | 0-8 |
| Protease (54.5 mg/g)[1] | 7.62 | 7.98 | 2.08 | 7.98 | 7.62 | 0-8 |
| Amylase (29.26 mg/g)[2] | 2.54 | 2.67 | 0.69 | 2.67 | 2.54 | 0-8 |
| Xyloglucanase[3] | 0-0.5 | — | 0.15 | — | 0-0.5 | 0-0.5 |
| Borax | 0-5 | 4.94 | — | — | 0-5 | 0-5 |
| Calcium Formate | 0.15 | 0.16 | 0.16 | 0.16 | 0.16 | 0.16 |
| Amphiphilic polymer [4] | 0-5 | 1.5 | 4.36 | — | 0-5 | — |
| Hexamethylene diamine, ethoxylated, quaternized, sulfated[5] | 0-2 | — | 1.68 | — | 0-2 | — |
| DTPA[6] (50% active) | 0.28 | 0.3 | 0.64 | 0.3 | 0.3 | 0.3 |
| Tiron ® | 0-1 | 0.89 | — | — | 0-1 | |
| Optical Brightener[7] | 0.34 | 0.37 | 0.36 | 0.35 | 0.36 | 0.36 |
| Ethanol | 0.97 | 4.1 | 2.99 | 4.1 | 2.99 | 2.99 |
| Propylene Glycol | 4.9 | 5.16 | 8.49 | 6.2 | 5.8 | 5.8 |
| Diethylene Glycol | — | — | 4.11 | — | — | — |
| Monoethanolamine (MEA) | 1.12 | 1.17 | 0.23 | 1.17 | 1.12 | 1.12 |
| Caustic Soda (NaOH) | 3.5 | 3.74 | 2.1 | 3.5 | 3.7 | 3.7 |
| Na Formate | 0.61 | 0.64 | 0.23 | 0.63 | 0.4 | 0.4 |
| Na Cumene Sulfonate | — | — | 1 | — | — | — |
| Dye | 0.01 | — | 0.02 | 0.01 | 0.01 | 0.01 |
| Perfume | 0.85 | — | 1 | 0.5 | 0.6 | 0.6 |
| Preservative[8] | 0.05 | 0.5 | — | 0.5 | 0.5 | 0.5 |
| Hydrogenated castor oil | — | — | 0.27 | — | — | — |
| Water | Q.S. | Q.S. | Q.S. | Q.S. | Q.S. | Q.S. |

[1]Proteases may be supplied by Genencor International, Palo Alto, California, USA (e.g., Purafect Prime ®, Excellase ®) or by Novozymes, Bagsvaerd, Denmark (e.g. Liquanase ®, Coronase ®).
[2]Available from Novozymes, Bagsvaerd, Denmark (e.g., Natalase ®, Mannaway ®).
[3]Available from Novozymes (e.g., Whitezyme ®).
[4]Random graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units, available from BASF as Sokalan PG101 ®.
[5]A compound having the following general structure: bis$((C_2H_5O)(C_2H_4O)_n)(CH_3)$—$N^+$—$C_xH_{2x}$—$N^+$—$(CH_3)$-bis$((C_2H_5O)(C_2H_4O)_n)$, wherein n = from 20 to 30, and x = from 3 to 8, or sulphated or sulphonated variants thereof, available from BASF as Lutenzit Z 96 ®
[6]DTPA is diethylenetriaminepentaacetic acid supplied by Dow Chemical, Midland, Michigan, USA.
[7]Suitable Fluorescent Whitening Agents are for example, Tinopal ® AMS, Tinopal ® CBS-X, Sulphonated zinc phthalocyanine Ciba Specialty Chemicals, Basel, Switzerland. It can be provided in the amount ranging from 0-5%.
[8]Suitable preservatives include methylisothiazolinone (MIT) or benzisothiazolinone (BIT), which can be provided in the amount ranging from 0-1%.

Example 6: Exemplary Unite Dose Formulations (with Concentrated Liquid Detergent)

The following concentrated liquid laundry detergent compositions 6A-6E are prepared and then each encapsulated in a multi-compartment pouch formed by a polyvinyl alcohol-film.

| Ingredients (wt %) | 6A | 6B | 6C | 6D | 6E |
|---|---|---|---|---|---|
| BAS | 30 | 40 | 50 | 35 | 45 |
| $AE_{1.8}S$ (or $AE_3S$) | 0 | 0.2 | 0 | 0.2 | 0 |
| MCAS | 10 | 15 | 8 | 12 | 5 |
| LAS | 0 | 10 | 15 | 0 | 5 |
| Citric Acid | 0.65 | 1.55 | 2 | 2 | 2 |
| Fatty acid | 1-6.5 | 6.27 | 6 | 6 | 1-6.5 |
| Chelants | 1.16 | 0.62 | 0.82 | 0.82 | 0.62 |
| Cleaning polymers | 7.42 | 5.33 | 6.24 | 6.24 | 5.33 |
| Enzymes | 0.11 | 0.12 | 0.11 | 0.12 | 0.12 |
| Brightener 49 | 0.18 | 0.19 | 0.18 | 0.19 | 0.19 |
| Structurant | 0.1 | 0.1 | 0.1 | 0.1 | 0.1 |
| Solvents* | 17-20 | 17.96 | 18 | 23 | 20-25 |
| Water | 10-12 | 11.66 | 11.66 | 11.66 | 10-12 |
| Perfume | 1.63 | 1.7 | 1.7 | 1.7 | 1.7 |
| Aesthetics | 1.48 | 1.13 | 1.25 | 1.25 | 1.25 |
| Monoethanolamine or NaOH (or mixture thereof) | 6.69 | 9.75 | 7.82 | 7.82 | 7.82 |
| Other laundry adjuncts/misc. | Q.S. | Q.S. | Q.S. | Q.S. | Q.S. |

*May include, but not limited to propanediol, glycerol, ethanol, dipropyleneglycol, polyetheyleneglycol, polypropyleneglycol.

Example 7: Exemplary Dish Wash Detergent (with Concentrated Liquid Detergent)

Dish wash detergent composition 13A-13F are formulated according to the present invention by mixing together with ingredients listed.

| Ingredients (wt %) | 7A | 7B | 7C | 7D | 7E | 7F |
|---|---|---|---|---|---|---|
| BAS | 20 | 30 | 40 | 50 | 35 | 45 |
| $AE_{1.8}S$ (or $AE_3S$) | 0.2 | 0 | 0.2 | 0 | 0.2 | 0 |
| MCAS | 4 | 5 | 0 | 8 | 12 | 0 |
| C12-14 dimethyl amine oxide | 0-5 | 2 | 0 | 0 | 5.45 | 0-5 |
| Branched Nonionic: 3-propyl heptanol EO8 | 0-4 | 0 | 0 | 1 | 0.40 | 0-4 |
| PEI600-EO10-PO7 block polymer | 0.3 | 0.3 | 0.3 | 0.3 | 0.3 | 0.3 |
| Ethanol | 2.5 | 2.5 | 2.5 | 2.5 | 2.5 | 2.5 |
| Polypropylene glycol MW2000 | 0.4 | 0.4 | 0.4 | 0.4 | 0.4 | 0.4 |
| Sodium Chloride | 1.0 | 1.0 | 1.0 | 1.0 | 1.0 | 1.0 |
| Poly-(VP-co-DADMAC) polymer | 0-1 | 0 | 0 | 0 | — | 0-1 |
| Minors* and water | | | Balance | | | |

*Minors include perfume, dyes, and preservatives
VP: vinylpyrrolidone
DADMAC: N,N-dimethyldiallylammonium chloride All percentages and ratios are calculated by weight unless otherwise indicated. All percentages and ratios are calculated based on the total composition unless otherwise indicated. It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cleaning composition having a surfactant system comprising about 12% by total weight of the cleaning composition of one or more branched, unalkoxylated $C_6$-$C_{14}$ alkyl sulfate (BAS) surfactants, wherein said one or more BAS surfactants account for more than 90% by total weight of the surfactant system, and wherein said cleaning composition is free of any alkoxylated alkyl sulfate (AxS) and suds suppressors, wherein the one or more BAS surfactants comprise branched alkyl moieties with a weight average carbon atom number ranging from 11 to 13, wherein said one or more BAS surfactants are a mixture comprising: (1) a branched, unalkoxylated $C_{12}$ alkyl sulfate surfactant in the amount ranging from 40% to 50%, by total weight of said mixture; and (2) a branched, unalkoxylated $C_{13}$ alkyl sulfate surfactant in the amount ranging from 40% to 50%, by total weight of said mixture, wherein said surfactant system further comprises one or more linear, unalkoxylated $C_6$-$C_{20}$ alkyl sulphate surfactants (AS), wherein said one or more AS surfactants are a mixture comprising: (1) a linear, unalkoxylated $C_{12}$ alkyl sulfate surfactant in the amount ranging from 70% to 80%, by total weight of said mixture; and (2) a linear, unalkoxylated $C_{14}$ alkyl sulfate surfactant in the amount ranging from 20% to 30%, by total weight of said mixture wherein said one or more AS are present in an amount ranging from 1% to 5%, by total weight of the cleaning composition, wherein said cleaning composition has a sudsing profile characterized by: a) an Initial Wash Suds Volume (by height) of no less than 30 cm; b) a Suds Mileage (by height) of no less than 30 cm; a Suds Retention Percentage of no less than about 60%; and c) a Rinse Suds Reduction Rate (by height) of no less than 40%/min, which are measured according to the Sudsing Profile Test described herein, wherein the composition further comprises a carboxymethyl cellulose, an acrylic acid/maleic acid copolymer, a polyethylene glycol-Polyvinyl acetate graft polymer, a silicate, a carbonate and a sulfate.

2. The cleaning composition according to claim 1, wherein the weight ratio of said one or more BAS surfactants to said one or more AS surfactants ranges from 3:1 to 5:1.

3. The cleaning composition according to claim 1, wherein said detergent composition is a granular detergent composition that further comprises: (a) from 3% to 25%, of a water-soluble alkali metal carbonate, by total weight of said granular detergent composition; and/or (b) from 30% to 80%, of a water-soluble alkali metal sulfate, by total weight of said granular detergent composition; and/or (c) from 30% to 80%, of a water-soluble alkali metal chloride, by total weight of said granular detergent composition.

4. A method of treating a soiled material, comprising the steps of:

a) providing a cleaning composition according to claim 1;

b) contacting the cleaning composition with at least a portion of the soiled material; and c) rinsing the soiled material.

* * * * *